US009789026B2

(12) United States Patent
Hanson

(10) Patent No.: US 9,789,026 B2
(45) Date of Patent: Oct. 17, 2017

(54) CARDIOPULMONARY RESUSCITATION DEVICE AND METHOD OF USE

(71) Applicant: Joseph Hanson, Naples, FL (US)

(72) Inventor: Joseph Hanson, Naples, FL (US)

(73) Assignee: Joseph Hanson, Naples, FL (US)

( * ) Notice: Subject to any disclaimer, the term of this patent is extended or adjusted under 35 U.S.C. 154(b) by 0 days.

(21) Appl. No.: 14/430,944

(22) PCT Filed: Sep. 25, 2012

(86) PCT No.: PCT/US2012/057112
§ 371 (c)(1),
(2) Date: Mar. 25, 2015

(87) PCT Pub. No.: WO2014/051551
PCT Pub. Date: Apr. 3, 2014

(65) Prior Publication Data

US 2015/0224022 A1 Aug. 13, 2015

(51) Int. Cl.
*A61H 31/00* (2006.01)

(52) U.S. Cl.
CPC ..... *A61H 31/007* (2013.01); *A61H 31/00* (2013.01); *A61H 31/004* (2013.01); *A61H 31/005* (2013.01); *A61H 2201/018* (2013.01); *A61H 2201/1253* (2013.01); *A61H 2205/084* (2013.01)

(58) Field of Classification Search
CPC ..... A61H 7/00; A61H 7/003; A61H 7/001; A61H 23/00; A61H 23/006; A61H 23/06; A61H 2023/002; A61H 31/00; A61H 31/004; A61H 31/005; A61H 31/006; A61H 31/007; A61H 2031/001; A61H 2031/002; A61H 2031/003
USPC ..... 601/43, 41, 42, 44, 6, 133–135, 84, 97, 601/107, 149; 128/DIG. 3; D24/167
See application file for complete search history.

(56) References Cited

U.S. PATENT DOCUMENTS

| | | | | |
|---|---|---|---|---|
| 2,036,248 | A | 4/1936 | Acklen | |
| 4,361,140 | A | 11/1982 | Barkalow | |
| 4,554,910 | A | 11/1985 | Lally | |
| 4,570,615 | A | 2/1986 | Barkalow | |
| 4,664,098 | A * | 5/1987 | Woudenberg ..... | A61H 9/0078 601/106 |

(Continued)

FOREIGN PATENT DOCUMENTS

| | | |
|---|---|---|
| GB | 1526021 | 9/1978 |
| JP | H01-503444 | 11/1989 |

(Continued)

OTHER PUBLICATIONS

European supplementary search report for EP application No. 12885893.3 dated Feb. 3, 2016.

(Continued)

*Primary Examiner* — Justine Yu
*Assistant Examiner* — Colin W Stuart
(74) *Attorney, Agent, or Firm* — Michael Best & Friedrich LLP

(57) ABSTRACT

A manual cardiopulmonary resuscitation device for delivering chest compressions to a patient needing CPR. The device includes a handle, a deformable housing filled with foam, and a bottom plate. The deformable housing includes a first end coupled to the handle and a second end coupled to the bottom plate.

15 Claims, 5 Drawing Sheets

(56) References Cited

U.S. PATENT DOCUMENTS

| | | | | |
|---|---|---|---|---|
| 4,915,095 | A | 4/1990 | Chun | |
| 5,109,833 | A | 5/1992 | Frimberger | |
| 5,313,938 | A | 5/1994 | Garfield et al. | |
| 5,377,860 | A | 1/1995 | Littlejohn et al. | |
| 5,645,522 | A | 7/1997 | Lurie et al. | |
| 5,657,751 | A | 8/1997 | Karr, Jr. | |
| 5,823,185 | A | 10/1998 | Chang | |
| 6,397,843 | B1 | 6/2002 | Tien-Tsai | |
| 2003/0004445 | A1 | 1/2003 | Hall et al. | |
| 2005/0015026 | A1* | 1/2005 | Well | A61H 31/006 601/44 |
| 2007/0088233 | A1 | 4/2007 | Wood | |
| 2009/0093741 | A1 | 4/2009 | Lach | |
| 2010/0239845 | A1* | 9/2010 | Maekawa | B29C 44/3469 428/315.7 |
| 2011/0201979 | A1* | 8/2011 | Voss | A61H 31/005 601/41 |

FOREIGN PATENT DOCUMENTS

| | | |
|---|---|---|
| JP | 6343701 | 12/1994 |
| JP | H06-343701 | 12/1994 |
| JP | H07-27565 | 5/1995 |
| JP | 2009501569 | 1/2009 |
| JP | 3167750 | 4/2011 |
| KR | 20030078186 | 10/2003 |
| WO | 87/07844 | 12/1987 |
| WO | 02091905 | 11/2002 |
| WO | 2011100694 | 8/2011 |

OTHER PUBLICATIONS

European Search Report for EP 11871378.3 dated Mar. 3, 2015.
Japanese Office action for JP2014-527132 dated May 12, 2015.
Advanced Circulatory Systems, Inc., ResQPump Instructions for Use, publicly available prior to Aug. 25, 2011, (8 pages).
Fauber, John, "Medical College study finds little benefit in CPR device," Journal Sentinel, Sep. 1, 2011, (5 pages).
Advanced Circulatory Systems, Inc., ResQPOD product brochure and web site; http://www.advancedcirculatory.com/resqpod/product_overview.htm, publicly available prior to Aug. 25, 2011, (3 pages).
LUCAS External Cardiac Compressor Instructions for Use, publicly available prior to Aug. 25, 2011, (23 pages).
LUCAS Chest compression System Instructions for Use, publicly available prior to Aug. 25, 2011, (40 pages).
PCT International Search Report and Written Opinion for PCT/US2011/049157 dated May 2, 2012 (9 pages).
PCT International Search Report and Written Opinion for PCT/US2012/057112 dated Apr. 8, 2013, (11 pages).
Office Action from the US Patent and Trademark Office for U.S. Appl. No. 14/188,401 dated Jun. 28, 2016 (19 pages).
Japanese Office action for JP Application No. 2015-534441 dated May 23, 2016.

* cited by examiner

CARDIOPULMONARY RESUSCITATION DEVICE AND METHOD OF USE

FIELD OF THE INVENTION

The present invention relates to a cardiopulmonary resuscitation (CPR) aid.

BACKGROUND OF THE INVENTION

Cardiopulmonary resuscitation or CPR is a combination of rescue breathing (mouth-to-mouth resuscitation) and chest compressions. If a person is not breathing or circulating blood adequately, CPR can restore circulation of oxygen-rich blood to the brain and heart. CPR may be necessary during many different emergencies, including cardiac arrest, accidents, near-drowning, drug overdose, suffocation, poisoning, smoke inhalation, and electrocution injuries.

CPR involves administering a number of chest compressions, each at a specified rate and force, separated by moments of artificial respiration therebetween. When a user is performing CPR, accuracy in performing the task is important. The timing, number and force of each chest compression must be precisely executed to assure maximum effect of the procedure on the person. Furthermore, since providing CPR is usually done during times of duress, keeping track of the compressions, keeping an even rhythm, and maintaining a constant compression force can be difficult, especially for an untrained or newly certified user.

SUMMARY OF THE INVENTION

In 2010, the American Heart Association and International Liaison Committee on Resuscitation updated their CPR guidelines. See Field, J. M., et al., "Part 1: executive summary: 2010 American Heart Association Guidelines for Cardiopulmonary Resuscitation and Emergency Cardiovascular Care," Circulation 122 (18 Suppl 3): S640-56 (November 2010). The importance of high quality CPR (sufficient rate and depth without excessively ventilating) was emphasized and the experts agreed that it is important to reduce time to first chest compressions. Therefore, the order of interventions for basic life support was changed for all age groups except newborns from airway, breathing, chest compressions (ABC) to chest compressions, airway, breathing (CAB).

According to the updated CPR guidelines (Berg, Robert A. et al., "Part 5: Adult Basic Life Support: 2010 American Heart Association Guidelines for Cardiopulmonary Resuscitation and Emergency Cardiovascular Care," Circulation 122 (18 Suppl 3): S685-S705 (November 2010), chest compressions consist of forceful rhythmic applications of pressure over the lower half of the sternum. These compressions create blood flow by increasing intrathoracic pressure and directly compressing the heart. This generates blood flow and oxygen delivery to the myocardium and brain. Effective chest compressions are essential for providing blood flow during CPR. For this reason, it is recommended that all patients in cardiac arrest should receive chest compressions.

To provide effective chest compressions, laypersons and healthcare providers need to push hard and push fast over the lower half of the sternum. It is reasonable for laypersons and healthcare providers to compress the adult chest at a rate of at least 100 compressions per minute with a compression depth of at least 2 inches (5 cm). Rescuers should allow complete recoil of the chest after each compression, to allow the heart to fill completely before the next compression.

Rescuers should attempt to minimize the frequency and duration of interruptions in compressions to maximize the number of compressions delivered per minute. A compression-ventilation ratio of 30:2 is recommended.

In a first AHA recommended CPR protocol, once chest compressions have been started, a trained rescuer should deliver rescue breaths by mouth-to-mouth or bag-mask to provide oxygenation and ventilation, as follows:

1. Deliver each rescue breath over 1 second.
2. Give a sufficient tidal volume to produce visible chest rise.
3. Use a compression to ventilation ratio of 30 chest compressions to 2 ventilations.

The AHA also recommends a second CPR protocol known as Hands Only™CPR. Hands Only CPR is CPR without mouth-to-mouth breaths. The 2010 AHA guidelines reported that in studies of out-of-hospital cardiac arrest, adults who received Hands-Only CPR from a bystander were more likely to survive than those who didn't receive any type of CPR from a bystander. In other studies, survival rates of adults with cardiac arrest treated by people who weren't healthcare professionals were similar with either Hands-Only CPR or conventional CPR. When interviewed, bystanders said panic was the major obstacle to performing CPR. The simpler Hands-Only technique may help overcome panic and hesitation to act.

The present invention is configured to provide a readily available hand held assist mechanism for "good samaritans" and first responders. By providing a simple disposable hand held assist product for CPR, it may improve bystanders' willingness to become a "good samaritan."

The updated CPR guidelines recommend chest compressions at a rate of at least 100/minute. Studies have shown that higher compression rates are associated with higher survival rates. However, it is difficult for a layperson or first responder to apply rapid compressions at the recommended rate of 100/minute. Accordingly, the present invention provides an ergonomical device that makes is easier to accomplish the rapid compressions at the recommended rate. The device features an integral non-slip circular handle that forces the CPR responder's hands and wrist to remain in a relatively neutral posture during chest compression. The device also includes a pre-programmed verbal instruction set that is combined with an optional voice prompt to "push, push, push, . . ." at the AHA-recommended rate of 100 compressions/minute.

The present invention relates to a device for assisting a layperson, rescuer, or healthcare provider in providing effective chest compressions as discussed above. In some exemplary embodiments, the invention provides a manual cardiopulmonary resuscitation device. The device includes a handle, a deformable housing having a first end and a second end, the first end connected to the handle, foam that is positioned within the deformable housing, and a bottom plate attached to the second end of the housing, wherein the bottom plate is formed of a flexible material.

In another exemplary embodiment, the present invention provides a manual cardiopulmonary resuscitation device comprising a handle defining an exhaust aperture therein, a deformable housing having an outer wall defining a cavity therein, the deformable housing having a first end and a second end opposite the first end, wherein the first end is coupled to the handle, and wherein the cavity is in fluid communication with the outer atmosphere via the exhaust aperture, foam positioned within the cavity, and a bottom plate coupled to the second end of the deformable housing, the bottom plate formed from a flexible material.

In yet another exemplary embodiment, A manual cardiopulmonary resuscitation device kit comprising a handle defining an exhaust aperture therein, a bottom plate including a silicone base configured to contact a patient's chest, and a deformable housing having a first end coupleable to the handle, and a second end coupleable to the bottom plate, and defining a cavity therein, the deformable housing being filled with foam, and where the deformable housing is configured to deform from a first configuration to a second configuration when pressure is applied to the handle.

The present invention also provides a method of using a manual cardiopulmonary resuscitation device having a handle, a deformable housing, and a bottom plate in contact with a user. The method comprises applying a first compression force to the handle, at least partially compressing the deformable housing, and applying a second compression force to the patient different from the first compression force.

DETAILED DESCRIPTION

Figure 1:
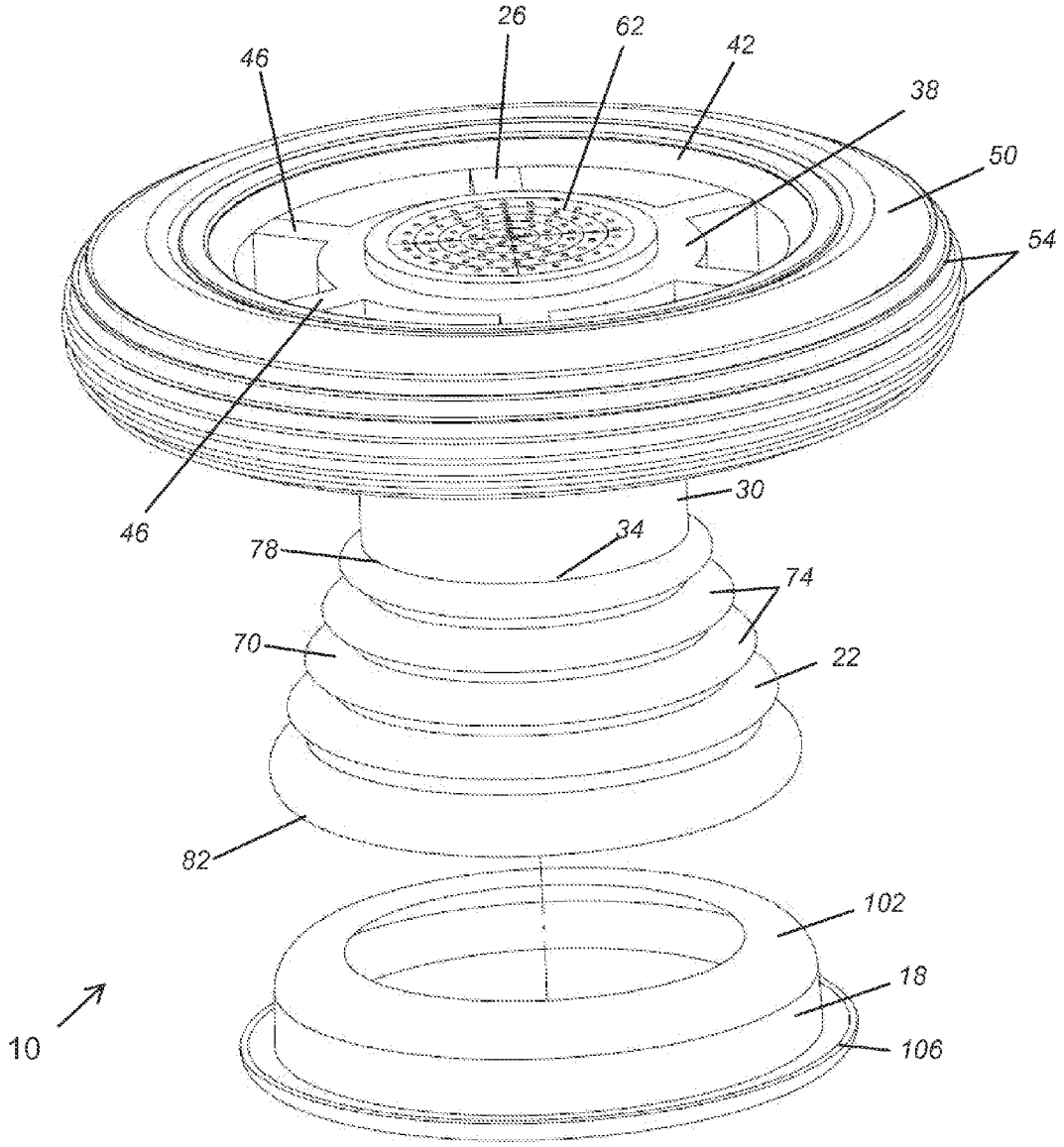
FIG. 1 is a perspective view of a cardiopulmonary resuscitation device according to an embodiment of the present invention.
Figure 2:
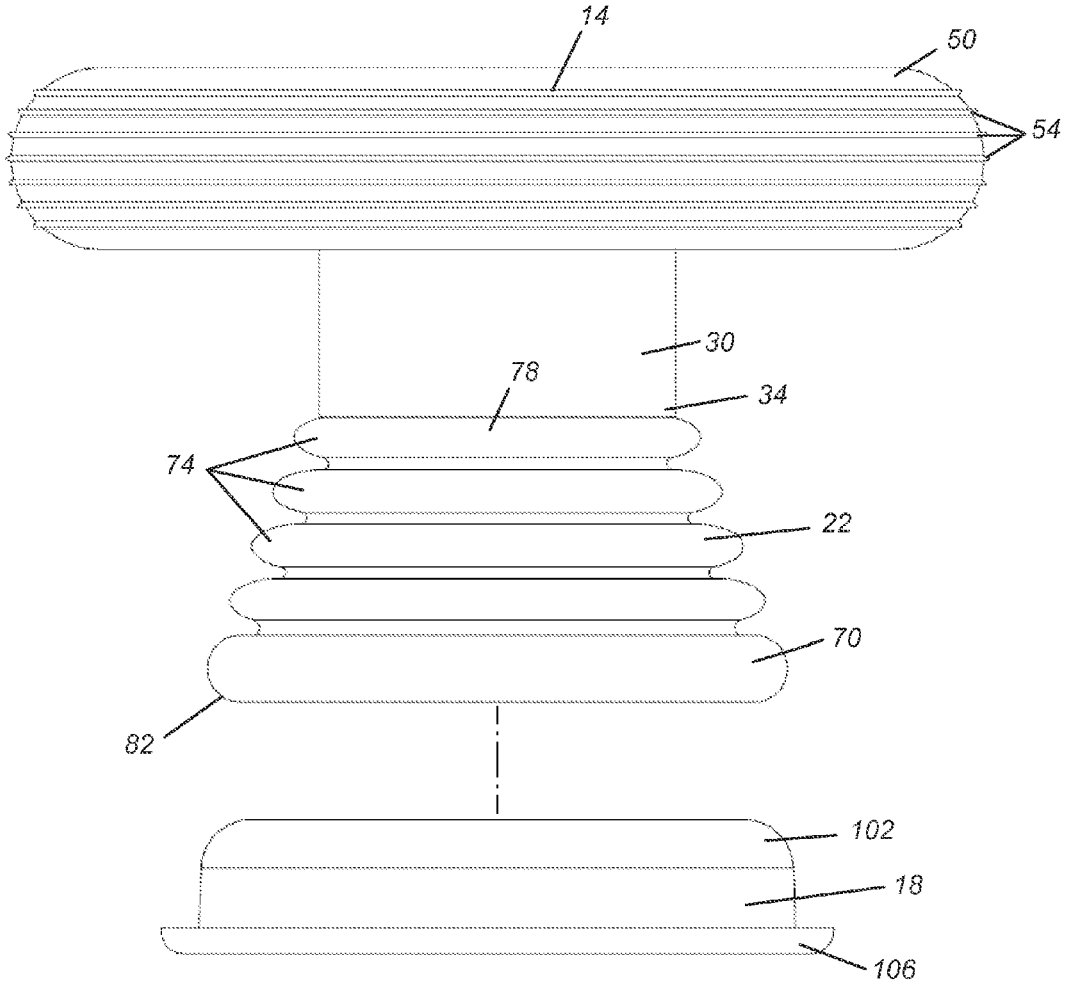
FIG. 2 is a side view of the cardiopulmonary resuscitation device illustrated in FIG. 1.

It is to be understood that the invention is not limited in its application to the details of construction and the arrangements of the components set forth in the following description or embodiments, or illustrated in the drawings. The invention is capable of other embodiments and of being practiced or being carried out in various ways. Also, it is to be understood that the phraseology and terminology used herein is for the purpose of description and should not be regarded as limiting.

FIGS. 1-4 illustrate a cardiopulmonary resuscitation (CPR) device 10 according to one embodiment of the present invention. The CPR device 10 is configured to aid a user while performing CPR on a patient. The device 10 is held by the user and placed on the patient's chest, at which time the user presses down onto the device 10 repeatedly in short, quick strokes to perform chest compressions in accordance with CPR procedures. During use, the device 10 may also provide audio and/or visual instructions to the user in real-time regarding any one of the force, timing, and number of compressions administered to the patient. The device 10 may also modify (e.g., reduce) the force applied by the user so that the patient does not experience any potentially harmful forces.

In the illustrated construction of FIGS. 1-4, the device 10 includes a handle 14, a bottom cover 18 positionable on the patient's chest, and a deformable housing 22 extending between the bottom cover 18 and the handle 14 to transmit force therebetween. In some constructions, the device 10 also includes an electronics assembly 16 to provide visual and/or audio instructions to the user while he or she administers CPR.

Illustrated in FIGS. 1-4, the handle 14 of the CPR device 10 includes a body 26 defining a periphery, and a support collar or protrusion 30 extending axially therefrom to produce a distal end 34. In one configuration, the handle 14 and the protrusion 30 are molded as a single-piece from ABS, PolyLac material. As illustrated in the figures, the body 26 is substantially circular-shaped, however, other suitable shapes for the body 26 are also contemplated. When assembled, the distal end 34 of the protrusion 30 is shaped to be coupled to one end of the deformable housing 22. During operation, the user grasps the handle 14, typically along its periphery, in such a way that allows the user to impart a vertical force into the device 10 and ultimately to the patient. Generally, the user leans or otherwise presses onto the handle 14 with both hands in a downward direction to apply compressive pressure to the patient's chest for each compression.

Figure 3:
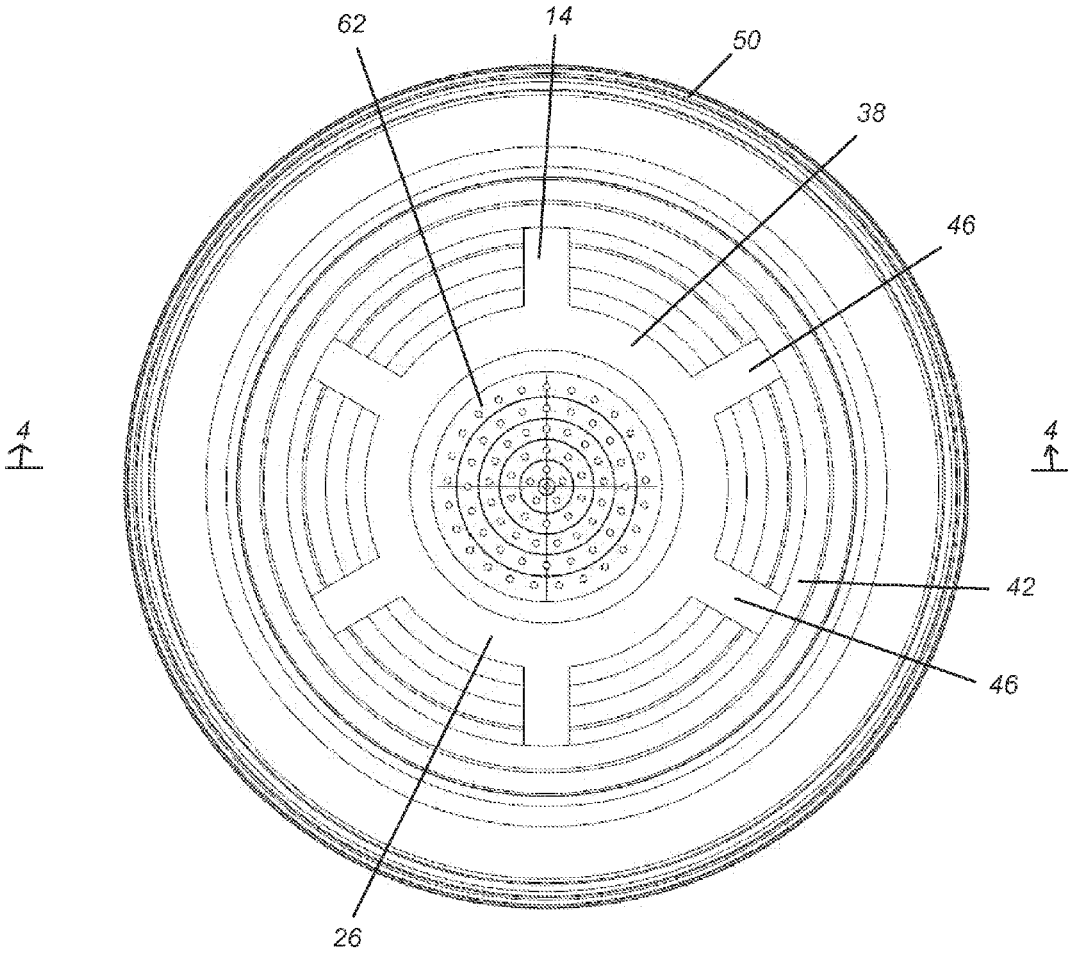
FIG. 3 is a top view of the cardiopulmonary resuscitation device illustrated in FIG. 1.
Figure 4:
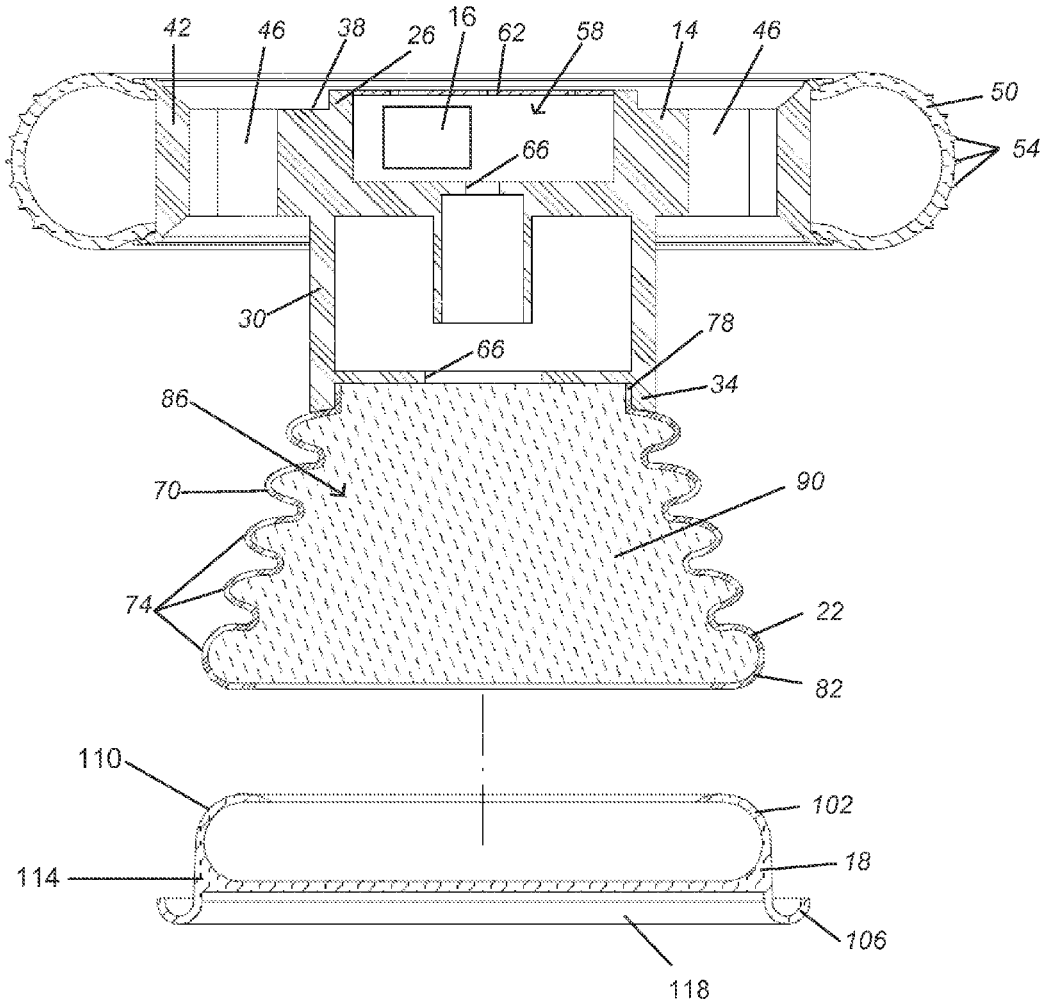
FIG. 4 is a cross-sectional view taken along line 4-4 of FIG. 3.

As best illustrated in FIGS. 1, 3, and 4, the body 26 of the handle 14 includes a central portion 38 and an outer portion 42 connected to the central portion 38 by a plurality of radially extending spokes 46. The body 26 also includes a grip 50 coupled to and extending along the outer portion 42 of the handle 14 to at least partially define the periphery. In the illustrated construction, the grip 50 forms a substantially arcuate cross-section and is over-molded with non-slip Styrene-Butadiene Copolymer. The grip 50 may also include ribs 54 for added texture and to assist the user in holding or grasping the handle 14. In alternate constructions, the grip 50 may also form alternate ergonomically appropriate cross-sections, or may include one or more finger grooves.

Figure 5:
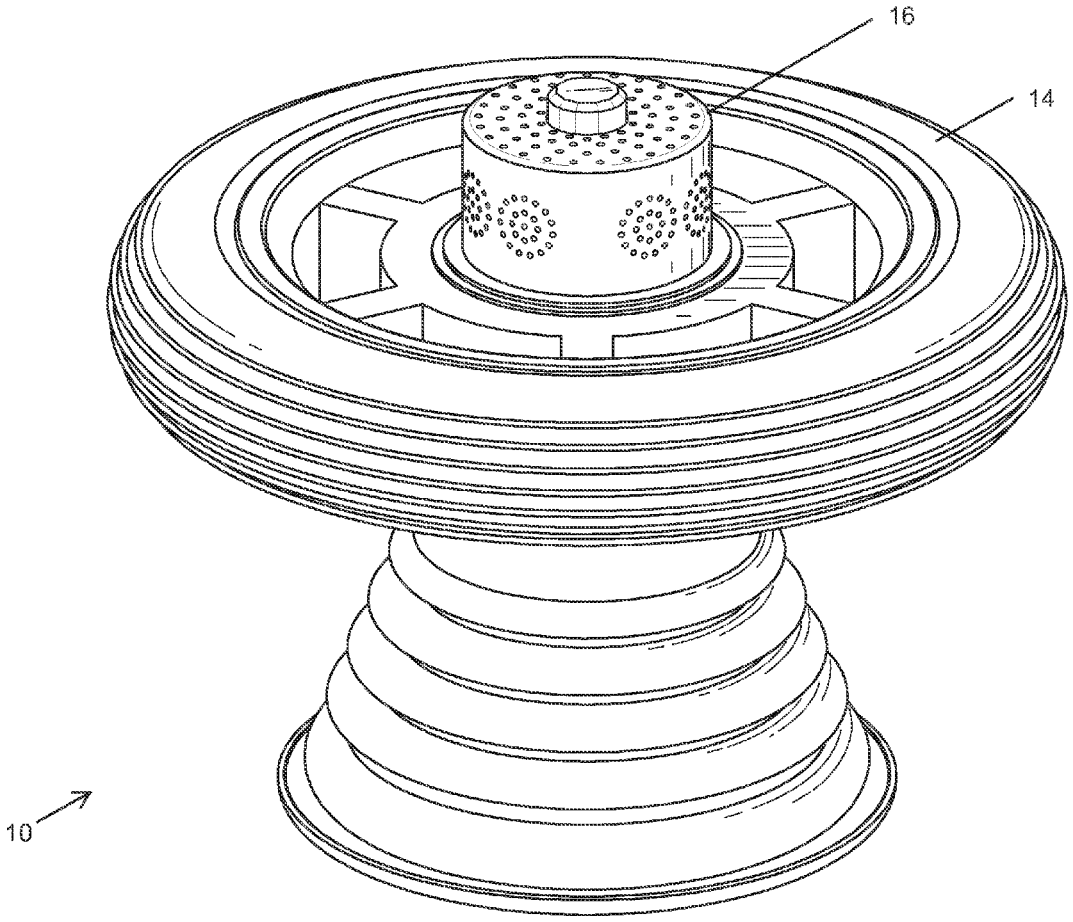
FIG. 5 is a perspective view of a cardiopulmonary resuscitation device according to an embodiment of the present invention.

The body 26 also defines a first compartment 58 sized to contain an electronics module 16 therein to provide audio and/or visual cues to the user. The compartment 58 is at least partially defined by a cover 62 (see FIG. 4) having perforations formed therein for sound output and airflow. In some constructions, the cover 62 may also include a button or other user input to activate the electronic module contained therein. In another construction, illustrated in FIG. 5, the electronics module 16 is mounted to the handle 14.

The electronics module 16 is configured to provide audio and/or visual prompts at predetermined intervals that coincide with the recommendations of the AHA CPR Guidelines, providing a metronome effect. The electronics module 16 may also include a battery (e.g., a Duracell 3V123/Ultra battery) to power the electronic circuitry contained therein and one or more lamps or LEDs operable to illuminate to indicate that the electronics module 16 is active, and/or to illuminate at predetermined intervals that coincide with the recommendations of the AHA CPR Guidelines.

The body 26 also defines a plurality of exhaust apertures 66 to allow fluid communication between the deformable housing 22 and the surrounding atmosphere. Stated differently, air is allowed to enter and exit the deformable housing 22 freely as it compresses and expands during the CPR process.

Illustrated in FIGS. 1-5, the deformable housing 22 of the device 10 is somewhat conical in shape having an outer wall 70 that includes a plurality of pleats or folds 74, a first end 78 having a first perimeter, and a second end 82 having a second perimeter larger than the first perimeter. The housing 22 can comprise a low density polyethylene (LDPE, which may also be known as Polymer-E). When assembled, the distal end 34 of the handle 14 is attached to the first end 78 of the housing 22, and the bottom cover 18 is coupled to the second end 82 of the housing 22, defining a chamber 86 therebetween (see FIG. 4). More specifically, an expandable plastic fastener is mechanically deployed and secured to the first end 78 of the housing 22 and is received within or inserted into the protrusion 30. The expandable plastic fastener is deployed in order to assemble the handle 14 and the housing 22 prior to use on a patient.

The deformable housing 22 also includes foam 90 positioned within the chamber 86 of the outer wall 70. The foam 90 is generally formed from polycarbonate such as WONDERLITE® PC-122 supplied by the CHI MEI Corporation. In some constructions, the foam is injected into the chamber 86 allowing it to expand, cure, and conform to the shape and size of the outer wall 70. In other constructions, the foam may be inserted into the housing 22 piecemeal, with multiple pre-formed wedge shaped pieces being inserted, one at a time, until the chamber 86 is filled.

During use, the foam 90 transmits at least a portion of the force exerted onto the handle 14, through the bottom plate 18 and into the patient. More specifically, the foam core 90 deforms or collapses onto itself, absorbing a portion of the force provided by the user so that the patient experiences a second, smaller force. The foam-filled deformable housing 22 and its deformation characteristics may be analogized to a simple spring. Although the foam-filled deformable housing 22 does not behave purely as a simple spring, an effective spring constant, i.e., force/distance ratio, was determined, after experimental testing, to be about 25.4 lbf/in.

Generally speaking, the deformable housing 22 deforms between a first configuration, where the first end 78 is a first distance from the second end 82, and a second configuration, where the first end 78 is a second distance from the second end 82 whereby the second distance is smaller than the first distance. For example, in the first configuration, the first distance is predetermined in that the device 10 is at rest, whereas, in the second configuration, the second distance is variable (but ranges based on the height of the housing 22) and some amount of force is applied to the device such that the housing 22 is under compression. In one example, the first distance is in a range of about 50 mm—58 mm and the second distance is in a range of about 0 mm—53 mm. In the illustrated embodiment, the first distance is about 54 mm. The device 10 can assist the user in applying a range of forces to the patient. For example, testing of the device 10 under experimental conditions indicate that the device 10 can apply about 100-135 lbf compressive force to a patient's chest for a chest displacement of about 1.75-2.4 inches. More specifically, the device 10 can apply about 100-125 lbf compressive force to a patient's chest for a chest displacement of about 1.75-2.2 inches.

The deformable housing 22 is configured such that, as the volume of the chamber 86 increases and decreases due to the compression/deformation, air can travel into and out of the chamber 86 freely through the exhaust apertures 66 in the handle 14. Furthermore, the elasticity of the foam 90 and the outer wall 70 causes the housing 22 to naturally return to the first configuration.

As best illustrated in FIG. 4, the bottom plate 18 of the device 10 is formed from flexible material, such as silicone rubber or other suitable material or combinations of material, and is configured to contact and conform to the contours of the patient's chest. The silicone rubber provides for an evenly dispersed energy delivery to the patient. As illustrated in the figures, the bottom plate 18 is generally complementary-shaped to the shape of the second end 82 of the housing 22. The bottom plate 18 includes an annular wall 102 having an upper portion 110 and a lower portion 114. The upper portion 110 extends upwardly and radially inwardly towards a centerline of the bottom plate 18. The lower portion 114 extends downwardly and then upwardly and radially outwardly from the centerline of the bottom plate 18 thereby forming a groove 106. The upper portion 110 of the bottom plate 18 is configured to be received within the second end 82 of the housing 22, such that, when assembled, the annular wall 102 couples to the housing 22 with a friction fit. More specifically, the annular wall 102 encompasses one of the folds 74 of the outer wall 70. During assembly, the second end 82 of the housing 22 or a portion thereof may deform slightly in order to receive the upper portion 110 of the bottom plate 18.

The lower portion 114 of the bottom plate 18 is configured to engage the user's chest during the CPR process. The lower portion 114 extends radially outwardly in a curved shape designed to easily deform and seal with the patient. The bottom plate 18 also includes a silicone base 118 (e.g., medical grade) that can be applied to the patient's chest to secure or stabilize the device 10 thereto during compressions.

In the illustrated construction, the volume of air between the bottom plate 18 and the patient is in fluid communication with the chamber 86 of the housing 22, which in turn is in fluid communication with the outer atmosphere. As such, the present invention is a compression only device, which stated differently, means that the bottom plate 18 is not suctioned to the patient and will not allow the patient to undergo decompressions.

The CPR device 10 is assembled as a unit. An order of assembly is not intended by this description. The top of the bottom plate 18 is coupled to the second end 82 of the housing 22. The distal end 34 of the handle 14 is coupled to the first end 78 of the housing 22, and the electronics assembly is at least partially received within the compartment 58 of the handle 14.

The invention also provides a ready-to-use-kit. The kit comprises a pre-assembled device 10 supported in a carton along with a tray or envelope comprising gloves, wet wipes, a face shield, and instructions for use. Other items may also be included in the kit. In some configurations of the kit, the device 10 may not be fully pre-assembled. For example, the handle 14 and the housing 22 may be pre-assembled such that the user only needs to couple the bottom plate 18 to the housing 22.

Various features and advantages of the invention are set forth in the following claims.

What is claimed is:

1. A manual cardiopulmonary resuscitation device comprising:

a handle;

a deformable housing having a plurality of pleats or folds, a first end, and a second end, the first end connected to the handle;

foam that fills the deformable housing; and a bottom plate attached to the second end of the housing, wherein the bottom plate is formed of a flexible material, wherein the deformable housing is configured to deform and apply a compressive only force when pressure is applied to the handle, wherein the foam entirely fills the deformable housing.

2. The manual cardiopulmonary resuscitation device of claim 1, wherein the deformable housing is deformable between a first configuration, where the first end is a first distance from the second end, and a second configuration, where the first end is a second distance from the second end, wherein the second distance is less than the first distance.

3. The manual cardiopulmonary resuscitation device of claim 1, wherein the deformable housing is substantially conical in shape.

4. The manual cardiopulmonary resuscitation device of claim 1, wherein the deformable housing defines a cavity therein, and wherein the cavity is in fluid communication with the surrounding atmosphere.

5. The manual cardiopulmonary resuscitation device of claim 1 wherein the bottom plate comprises a silicone base.

6. A method of using a manual cardiopulmonary resuscitation device having a handle, a deformable housing having a plurality of pleats or folds and defining a cavity entirely filled with foam, and a bottom plate in contact with a patient, the method comprising:

applying a first compression force to the handle;

at least partially compressing the deformable housing; and applying a second compression force to the patient different from the first compression force, wherein the deformable housing is entirely filled with foam, and wherein at least partially compressing the deformable housing includes causing the foam to compress such that a compressive only force is applied to the patient.

7. The method of claim 6, wherein the first force is greater than the second force.

8. The method of claim 6, wherein at least partially compressing the deformable housing includes causing a first end of the deformable housing to move closer to a second end of the deformable housing.

9. A manual cardiopulmonary resuscitation device comprising:

a handle defining an exhaust aperture therein;

a deformable housing having an outer wall defining a cavity therein, the deformable housing having a plurality of pleats or folds, a first end, and a second end opposite the first end, wherein the first end is coupled to the handle, and wherein the cavity is in fluid communication with the outer atmosphere via the exhaust aperture;

foam that fills the cavity; and a bottom plate coupled to the second end of the deformable housing, the bottom plate formed from a flexible material, wherein the deformable housing is configured to deform and apply a compressive only force when pressure is applied to the handle, wherein the foam entirely fills the deformable housing.

10. The manual cardiopulmonary resuscitation device of claim 9, wherein the deformable housing is deformable between a first configuration, where the first end is a first distance from the second end, and a second configuration, where the first end is a second distance from the second end, and wherein the second distance is less than the first distance.

11. The manual cardiopulmonary resuscitation device of claim 10, wherein air moves into and out of the cavity from the exhaust aperture when the deformable housing deforms between the first configuration and the second configuration.

12. The manual cardiopulmonary resuscitation device of claim 9, further comprising an electronics module providing one of audio and visual prompts at predetermined intervals.

13. The manual cardiopulmonary resuscitation device of claim 9, wherein the deformable housing is substantially conical in shape.

14. The manual cardiopulmonary resuscitation device of claim 9 wherein the bottom plate comprises a silicone base.

15. A manual cardiopulmonary resuscitation device kit comprising:

a handle defining an exhaust aperture therein;

a bottom plate including a silicone base configured to contact a patient's chest; and a deformable housing having a plurality of pleats or folds, a first end coupleable to the handle, and a second end coupleable to the bottom plate, and defining a cavity therein, the deformable housing being entirely filled with foam, and where the deformable housing is configured to deform from a first configuration to a second configuration when pressure is applied to the handle.

* * * * *